US010330062B2

(12) United States Patent
Marchi et al.

(10) Patent No.: US 10,330,062 B2
(45) Date of Patent: Jun. 25, 2019

(54) INJECTOR FOR INJECTING FLUID

(71) Applicant: CONTINENTAL AUTOMOTIVE GMBH, Hannover (DE)

(72) Inventors: Luigi Marchi, Pisa (IT); Filippo Falaschi, Fauglia (IT); Ivano Izzo, Pisa (IT)

(73) Assignee: CPT Zwei GmbH, Nuremberg (DE)

( * ) Notice: Subject to any disclaimer, the term of this patent is extended or adjusted under 35 U.S.C. 154(b) by 0 days.

(21) Appl. No.: 15/485,797

(22) Filed: Apr. 12, 2017

(65) Prior Publication Data

US 2017/0218901 A1 Aug. 3, 2017

Related U.S. Application Data

(63) Continuation of application No. PCT/EP2015/071198, filed on Sep. 16, 2015.

(30) Foreign Application Priority Data

Oct. 15, 2014 (EP) ..... 14189105.1

(51) Int. Cl.
*F02M 51/06* (2006.01)
*F02M 61/20* (2006.01)
*F02M 61/12* (2006.01)

(52) U.S. Cl.
CPC .... *F02M 51/0632* (2013.01); *F02M 51/0685* (2013.01); *F02M 61/12* (2013.01); *F02M 61/20* (2013.01); *F02M 2200/304* (2013.01)

(58) Field of Classification Search
CPC .. F02M 51/06; F02M 51/061; F02M 51/0614; F02M 51/0625; F02M 51/0632;
(Continued)

(56) References Cited

U.S. PATENT DOCUMENTS

2011/0278368 A1* 11/2011 Hornby ..... F02M 51/0671 239/5
2012/0067982 A1 3/2012 Perry et al.
(Continued)

FOREIGN PATENT DOCUMENTS

DE 102006049253 A1 4/2008
DE 102006052816 A1 5/2008
(Continued)

OTHER PUBLICATIONS

Korean Office Action dated Jun. 26, 2018 for corresponding Korean Patent Application No. 10-2017-7010145.
(Continued)

*Primary Examiner* — Darren W Gorman

(57) ABSTRACT

An injector for injecting fluid with a valve assembly including a valve body and a valve needle, the needle including an armature retainer and being operable to prevent and to enable injection of fluid, and with an electromagnetic actuator assembly, operable to exert a force for influencing a position of the valve needle, including a pole piece and an armature. The pole piece is positionally fixed with the valve body. The armature is operable to be axially displaced relative to the pole piece and to take along the armature retainer when being displaced towards the pole piece. A fluid channel is defined by the armature retainer constriction surface and the pole piece constriction surface. A hydraulic diameter of the fluid channel is at least twice at large when the valve needle is in a closing position compared to the hydraulic diameter at a maximum displacement away from the closing position.

20 Claims, 4 Drawing Sheets

(58) Field of Classification Search
CPC ..... F02M 51/0653; F02M 51/066; F02M 51/0664; F02M 51/0671; F02M 51/0682; F02M 51/0685; F02M 61/20
See application file for complete search history.

(56) References Cited

U.S. PATENT DOCUMENTS

| | | | | |
|---|---|---|---|---|
| 2012/0318885 | A1* | 12/2012 | Grandi | F02M 51/066 239/5 |
| 2013/0221138 | A1* | 8/2013 | Rogler | F02M 51/0685 239/585.5 |
| 2014/0353409 | A1 | 12/2014 | Kim et al. | |
| 2016/0208750 | A1* | 7/2016 | Grandi | F02M 51/0685 |

FOREIGN PATENT DOCUMENTS

| | | | | |
|---|---|---|---|---|
| DE | 102010038437 | A1 | 2/2012 | |
| EP | 2375051 | A1 * | 10/2011 | F02M 51/0682 |
| EP | 2527637 | A1 | 11/2012 | |
| EP | 2570648 | A1 | 3/2013 | |
| EP | 2634412 | A1 | 9/2013 | |
| EP | 2706220 | A1 | 3/2014 | |
| EP | 2789844 | A1 | 10/2014 | |
| EP | 2851551 | A1 | 3/2015 | |
| JP | 2008031853 | A | 2/2008 | |
| JP | 2011241701 | A | 12/2011 | |
| WO | 2013085140 | A1 | 6/2013 | |

OTHER PUBLICATIONS

International Search Report and Written Opinion dated Nov. 11, 2015 from corresponding International Patent Application No. PCT/EP2015/071198.

European Search Report and Written Opinion dated Apr. 16, 2015 from corresponding European Patent Application No. 141891051.

First Office Action, National Intellectual Property Administration, P.R. China, dated Aug. 28, 2018, for CN counterpart application 201570055715.

Notice of Allowance, Korean Intellectual Property Office, dated Nov. 15, 2018, for counterpart KR application 10-2017-7010145.

* cited by examiner

INJECTOR FOR INJECTING FLUID

CROSS REFERENCE TO RELATED APPLICATIONS

This U.S. patent application claims the benefit of PCT patent application No. PCT/EP2015/071198, filed Sep. 16, 2015, which claims the benefit of European patent application No. 14189105.1, filed Oct. 15, 2014, all of which are hereby incorporated by reference herein.

FIELD OF INVENTION

The invention relates to an injector for injecting fluid and relates particularly to an injector for injecting fuel into an internal combustion engine.

BACKGROUND

Injection valves are in widespread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, diameter as well as various elements of the injection valve, which are responsible for the way the fluid is dosed, may vary within a wide range. In addition to that, injection valves may accommodate an actuator for actuating a valve needle of an injection valve, which may, for example, be an electromagnetic actuator.

In order to enhance the combustion process with regard to the reduction of unwanted emissions, the respective injection valve may be suited to dose fluids under very high pressure. The pressure may be, in the case of a gasoline engine, for example, in the range of up to 500 bar, and in the case of diesel engines in the range of up to 3500 bar.

SUMMARY

One object of the invention is to create an injector for injecting fluid that contributes to a controllability of an amount of injected fluid and enables efficient operation of the injector.

According to one aspect, an injector for injecting fluid comprises a valve assembly with a valve body and a valve needle. The valve body has a longitudinal axis and comprises a cavity with a valve seat. The valve needle is in particular solid, i.e., not hollow.

Furthermore, the valve needle comprises an armature retainer that is coupled in a fixed way to the valve needle. Moreover, the armature retainer comprises an armature retainer constriction surface.

The cavity is operable to take in the valve needle. The cavity and the valve needle are operable to prevent an injection of fluid from the cavity to external to the injector in a closing position of the valve needle, in which the valve needle is seated on the valve seat. Moreover, the cavity and the valve needle are operable to enable the injection of fluid when the valve needle is spaced apart from the closing position.

The injector further comprises an electromagnetic actuator assembly, which is operable to exert a force for influencing a position of the valve needle. The electromagnetic actuator assembly comprises a pole piece and an armature.

The pole piece is received in the cavity and positionally fixed within the valve body. The pole piece comprises a pole piece constriction surface facing towards the armature.

The armature is received in the cavity and operable to be axially displaced relative to the pole piece. The armature is further operable to take along the armature retainer when being displaced towards the pole piece.

A hydraulically effective restriction is preferably formed between the armature retainer constriction surface and the pole piece constriction surface, in particular in at least a range of an axial displacement of the valve needle from a maximum displacement away from the closing position to a restriction displacement. The hydraulically effective restriction in particular effects a first damping force which is exerted on the valve needle. In this context, the "restriction displacement" is in particular an axial position of the valve needle between the closing position and that axial position which corresponds to the maximum displacement away from the closing position.

In other words, a fluid channel is defined by a surface of the armature retainer—which is referred to as the armature retainer constriction surface—and a surface of the pole piece—which is referred to as the pole piece constriction surface. The fluid channel can be also be referred to as a gap. The hydraulically effective restriction is in particular represented by said fluid channel. In a preferred embodiment, fluid, which enters the cavity at a fluid inlet end of the valve body and flows to a fluid outlet end of the valve body where the valve seat is positioned, has to pass through the fluid channel.

A hydraulic diameter of the fluid channel is dependent on the axial displacement of the valve needle from the closing position. Specifically, the hydraulic diameter decreases with increasing displacement of the valve needle from the closing position. For example, the hydraulic diameter of the fluid channel is at least twice at large—and in one embodiment at least three times or four times as large—when the valve needle is in the closing position compared to the hydraulic diameter when the valve needle is at the maximum displacement away from the closing position. The reduction of the hydraulic diameter by the movement of the armature retainer against the hydraulic force of the fluid in the fluid channel may generate the first damping force.

Advantageously, a velocity of the valve needle is decreased by the first damping force such that an amount of injected fluid is suitably influenced. In particular, the first damping force contributes to a controllability of the injector in a ballistic phase of an opening phase of the injector. Particularly, a variation of the amount of injected fluid within a given time window is kept low. In other words, it is contributed to a controllability of the amount of injected fluid.

The restriction displacement of the valve needle away from the closing position may be greater than zero; for example, it has a value of one third of the maximum displacement or more. Moreover, the range in which the hydraulically effective restriction is formed may be greater than zero; for example, it has a value of 15% or more, in particular of 30% or more of the maximum displacement. In particular, the restriction displacement, respectively the range is dimensioned as to enable exertion of a desired damping force on the valve needle. Particularly, it is further dimensioned such that the velocity of the valve needle is substantially uninfluenced in a first portion of the opening phase of the injector, hence enabling efficient operation of the injector.

In one embodiment, the armature retainer constriction surface and the pole piece constriction surface comprise a smallest distance between the pole piece and the armature retainer at least when the valve needle is axially displaced in the range from the maximum displacement away from the closing position to the restriction displacement. Particularly, the armature retainer constriction surface and the pole piece constriction surface may comprise the smallest distance between the pole piece and the armature retainer when the valve needle is axially displaced to the maximum displacement and/or the restriction displacement.

In particular, the maximum displacement of the valve needle away from the closing position may be reached when the valve needle is in an opening position, in which the armature abuts the pole piece.

According to one embodiment, the armature retainer constriction surface has a first sloped shape. According to a further embodiment, the pole piece constriction surface has a second sloped shape. The first and/or second sloped shape may be a conical shape, for example, in particular a truncated conical shape. The second sloped shape may be equally sloped to the first sloped shape; in this case, the width of the fluid channel—i.e., the distance between the two constriction surfaces—is in particular independent from a position in the fluid channel along a flow direction of the fluid through the fluid channel. In particular, the armature retainer constriction surface with its first sloped shape and the pole piece constriction surface with its second sloped shape face each other in order to enable a suitable formation of the hydraulically effective restriction.

According to a further embodiment, the armature retainer constriction surface has a first curvature. Advantageously, the first curvature contributes to a prevention of jamming of the armature retainer, particularly when the valve needle is tilted. Particularly, the armature retainer is constructed convex, at least at the armature retainer constriction surface.

According to a further embodiment, the pole piece constriction surface has a second curvature. Advantageously, the second curvature contributes to a prevention of jamming of the armature retainer, particularly when the valve needle is tilted. Particularly, the pole piece is constructed concave, at least at the pole piece constriction surface.

According to a further embodiment, the second curvature is less than or equal to the first curvature. This enables the effective hydraulic restriction with merely a small section of the armature retainer, hence contributing to a reliable operation of the injector, particularly in the case when the valve needle is tilted.

According to a further embodiment, the first damping force exerted on the valve needle is dependent on the position of the valve needle. Advantageously, this allows for reliably decreasing the velocity of the valve needle in order to achieve a suitably controllable amount of injected fluid, particularly within the range between the maximum displacement of the valve needle and the restriction displacement, while keeping it substantially uninfluenced in the first instant of the opening phase of the injector which contributes to an efficient operation of the injector.

According to a further embodiment, the armature retainer comprises an armature retainer guiding surface. Moreover, the pole piece comprises a pole piece guiding surface. The armature retainer is operable for axially guiding the valve needle with the armature retainer guiding surface gliding along the pole piece guiding surface when the valve needle is axially displaced. In other words, the armature retainer has a side surface—referred to as the armature retainer guiding surface—and the pole piece has a side surface—referred to as the pole piece guiding surface—which are in sliding contact for axially guiding the valve needle. Advantageously, the axial guiding of the valve needle contributes to a prevention of tilting of the valve needle, thus enabling efficient operation of the injector.

According to a further embodiment, the armature retainer guiding surface is convexly curved with respect to the valve needle. A convex curvature of the armature retainer guiding surface contributes to a prevention of jamming of the armature retainer, particularly when the valve needle is tilted. Thus an efficient operation of the injector is enabled.

According to a further embodiment, the armature retainer guiding surface is substantially spherically shaped, i.e. it has the basic shape of a sphere. Advantageously, a spherical curvature of the armature retainer guiding surface contributes to a reliable prevention of jamming of the armature retainer, particularly when the valve needle is tilted, thus enabling an efficient operation of the injector.

According to a further embodiment, the armature retainer guiding surface comprises at least one axial channel for enabling a fluid flow axially through the cavity. This has the advantage that reliable guiding of the valve needle is enabled while also enabling efficient operation of the injector.

According to a further embodiment, the armature is axially movable relative to the valve needle. Advantageously, particularly when the armature abuts the pole piece or when the valve needle comes in contact with the valve seat, an axial movement of the valve needle may be decoupled from an axial movement of the armature. This, for example, contributes to a prevention of a transmission of an undesired bouncing of the armature to the valve needle, hence enabling efficient operation of the injector.

According to a further embodiment, the armature retainer comprises an armature retainer limiting surface for limiting an axial displacement of the armature relative to the valve needle. The armature retainer limiting surface is a surface of the armature retainer which faces towards the armature and laterally extends away from the valve needle. According to a further embodiment, the armature comprises an armature impact area facing towards the armature retainer limiting surface. The armature retainer limiting surface is operable to engage with the armature impact area. To put it differently, the armature retainer is in particular operable to limit the axial displacement of the armature relative to the valve needle by means of a form-fit engagement between a surface portion of the armature—referred to as the armature impact area—and the armature retainer limiting surface.

Particularly, the armature retainer limiting surface allows for a reliable force transmission of the armature to the valve needle. Particularly in the case that the armature is axially movable relative to the valve needle, the armature retainer limiting surface enables the valve needle to engage with the armature and to be taken along with the armature when the armature is axially displaced towards the pole piece. In the case that the injector further comprises a disc element, wherein the disc element is coupled in a fixed way to the valve needle for limiting an axial displacement of the armature relative to the valve needle away from the pole piece, the armature may be coupled to the valve needle by the disc element and the armature retainer limiting surface so that it has an axial play between the armature retainer limiting surface and the disc element.

In one embodiment, a lateral extension of the armature retainer limiting surface away from the valve needle is constructed such that a relative movement between the armature and the armature retainer is damped.

Advantageously the armature retainer limiting surface contributes to a prevention of bouncing of the valve needle, particularly when the armature abuts the pole piece. This contributes to an efficient operation of the injector.

For example, the armature impact area and the armature retainer limiting surface may be parallel. In particular, a lateral extension of the armature impact area away from the valve needle is constructed such that the relative movement between the armature and the armature retainer is damped. For this reason, the lateral extension of the armature impact area may be greater than or equal to the lateral extension of the armature retainer limiting surface.

In one embodiment, the armature retainer limiting surface and the armature retainer constriction surface are comprised by a stopper portion of the armature retainer and on opposite axial sides of the stopper portion. The armature retainer limiting surface and the armature retainer constriction surface are preferably inclined or curved relative to one another in such fashion that the stopper portion tapers in the radial outward direction.

In one development, the armature retainer further has a guiding portion which comprises the armature retainer guiding surface as its outer surface or as a portion of its outer surface. The guiding portion may expediently be arranged on the axial side of the stopper portion which is remote from the armature and in particular merges with the stopper portion. Preferably, the armature retainer has a constriction in a region where the guiding portion and the stopper portion merge.

In an advantageous development, the stopper portion—and therefore in particular the armature retainer limiting surface and the armature retainer constriction surface which both preferably extend radially to an outer contour of the stopper portion—projects radially beyond the guiding portion. Preferably, the maximum radial dimension of the stopper portion is at least twice as large as the maximum radial dimension of the guiding portion. Such dimensions are particularly advantageous for efficient damping of the relative movement between the armature and the armature retainer.

According to a further embodiment, the injector comprises a return spring, which is operable to bias the armature in an axial direction away from the armature retainer. For example, the armature return spring is seated in precompressed fashion against the armature retainer and the armature.

Advantageously, a large impulse transfer to the valve needle is enabled when the armature comes into contact with the armature retainer. This also enables an opening of the valve needle against a large hydraulic load with only limited actuator power. The return spring may particularly be seated on the armature retainer limiting surface.

BRIEF DESCRIPTION OF THE DRAWINGS

Exemplary embodiments of the invention are explained in the following with the aid of schematic drawings and reference numbers. Identical reference numbers designate elements or components with identical functions. In the drawings.

DETAILED DESCRIPTION

Figure 1:
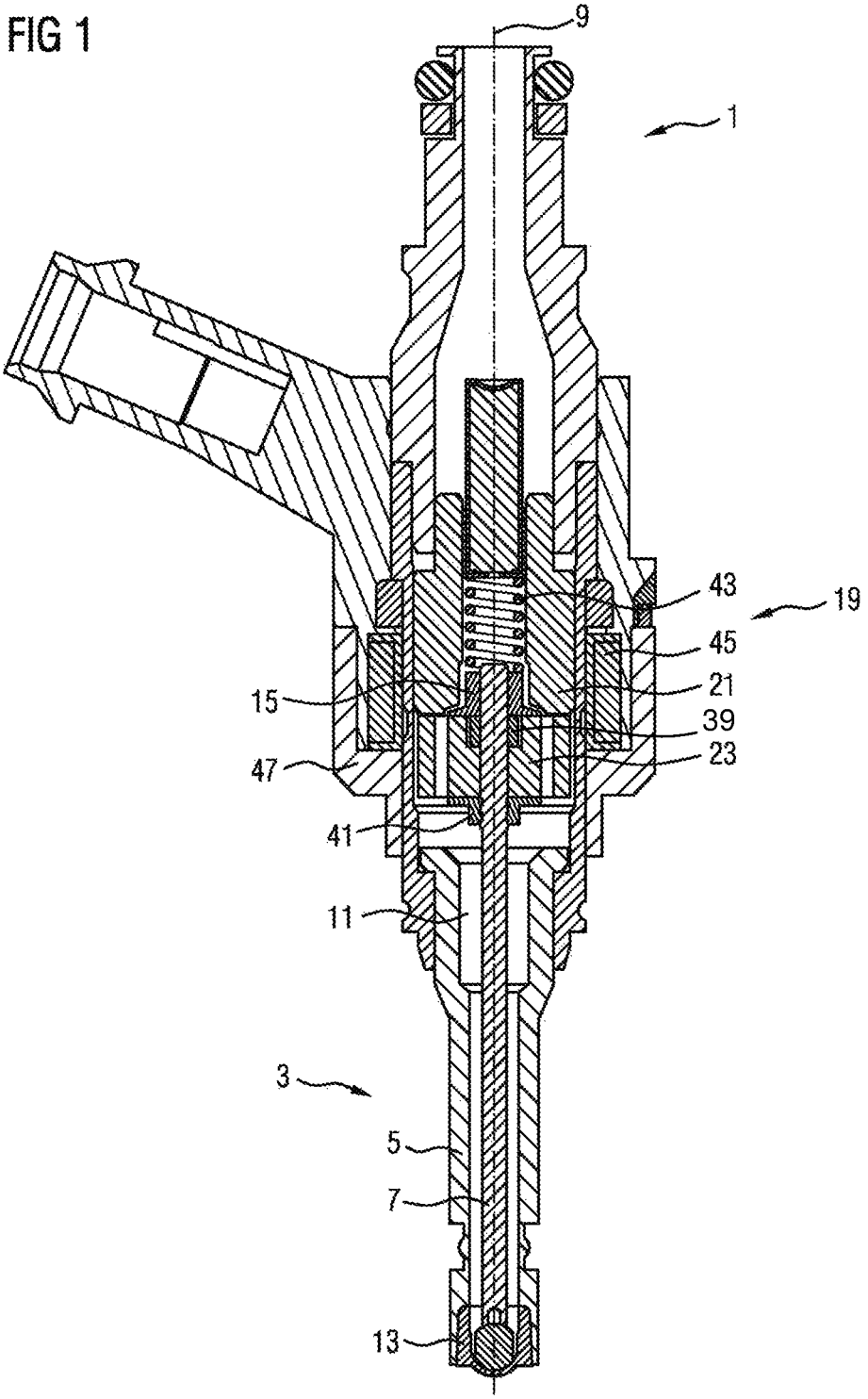
FIG. 1 is a longitudinal section view of a first embodiment of an injector.

FIG. 1 shows a first embodiment of an injector 1 with a valve assembly 3 and an electromagnetic actuator assembly 19. The valve assembly 3 comprises a valve body 5 and a valve needle 7. The valve body 5 has a longitudinal axis 9 and comprises a cavity 11 with a valve seat 13.

The valve needle 7 is received in the cavity 11 and is axially movable relative to the valve body 5. The valve needle 7 comprises an armature retainer 15 that is coupled in a fixed way to the valve needle 7. The valve needle 7 may further comprise a disc element 41 being axially displaced to the armature retainer 15 and coupled in a fixed way to the valve needle 7.

The valve needle 7 is operable to prevent an injection of fluid in a closing position, in which the valve needle 7 is seated on the valve seat 13, from the cavity 11 external to the injector 1, for example into a combustion chamber. The valve needle 7 is further operable to enable the injection of fluid when it is apart from the closing position. The injector 1 may comprise a valve spring 43 for biasing the valve needle 7 towards the closing position, for example in order to contribute to a leak tightness of the injector 1.

The electromagnetic actuator assembly 19 comprises a pole piece 21, an armature 23 and a magnetic coil 45, in particular solenoid, positioned in a housing which laterally surrounds at least a portion of the valve body 5. The magnetic coil 45, together with the armature 23 and the pole piece 21 forms a magnetic circuit of the electromagnetic actuator assembly 19 when the magnetic coil 45 is energized. In this context, the electromagnetic actuator assembly 19 may further comprise a yoke 47 for shaping the magnetic circuit of the electromagnetic actuator assembly 19.

The electromagnetic actuator assembly 19 is thus operable to exert a force for influencing a position of the valve needle 7. Particularly, the valve needle 7 may be axially displaced by the electromagnetic actuator assembly 19 relative to the valve body 5, for example in reciprocating fashion.

Figure 2:
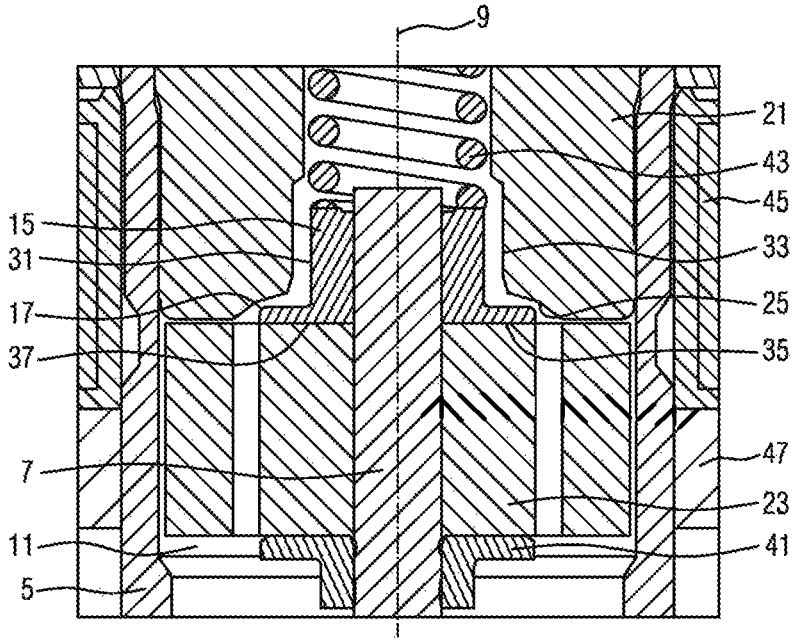
FIG. 2 is an enlarged longitudinal section view of the injector according to FIG. 1.

FIG. 2 shows an enlarged longitudinal section view of the injector according to FIG. 1, particularly of the electromagnetic actuator assembly 19. The pole piece 21 is received in the cavity 11 and positionally fixed with the valve body 5. In other embodiments, the pole piece 21 may be comprised by the valve body 5. The armature 23 is received in the cavity 11 and operable to be axially displaced relative to the pole piece 21. The armature 23 is further operable to take along the armature retainer 15 when being displaced towards the pole piece 21.

In this embodiment, the armature 23 is axially movable relative to the valve needle 7, particularly between the armature retainer 15 and the disc element 41, which both limit an axial displacement of the armature 23 relative to the valve needle 7. The armature 23 may comprise a return spring 39 in this context in order to enable a large impulse transfer to the valve needle 7 when the armature 23 comes into contact with the armature retainer 15. The return spring may further enable an opening of the valve needle 7 against large hydraulic loads with limited actuator power, for example 350 bar. In other embodiments, the armature 23 may be arranged to be positionally fixed to the valve needle 7. The armature 23 may further comprise at least one bore in order to allow an axial fluid flow through the cavity 11.

In this embodiment, the pole piece 21 comprises a pole piece guiding surface 33. Furthermore, the armature retainer 15 may comprise an armature retainer guiding surface 31. In this context, the pole piece 21 may comprise a recess with the pole piece guiding surface 33 in order to receive the armature retainer 15 with its armature retainer guiding surface 31. An axial guiding of the valve needle 7 is thereby provided, with the armature retainer guiding surface 31 gliding along the pole piece guiding surface 33 when the valve needle 7 is axially displaced.

Figure 4:
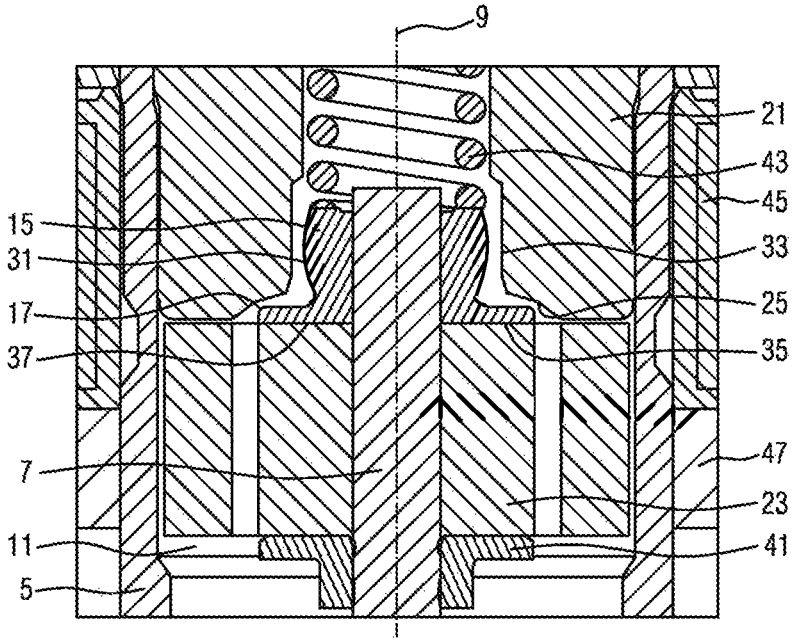
FIG. 4 is another enlarged longitudinal section view of the injector according to FIG. 1.

Particularly, the armature retainer guiding surface 31 is convexly curved with respect to the valve needle 7. In particular, it is, for example, substantially spherically shaped in order to avoid jamming of the armature retainer 15 when the valve needle 7 is tilted, as shown in FIG. 4.

Particularly, the armature retainer guiding surface 31 comprises at least one channel for enabling a fluid flow axially through the cavity 11. The at least one channel may be an axial recess of the armature retainer 15. In the representation of FIG. 2, the channels are visible on the left and right sides of the armature retainer 15 so that the spherical basic shape is not visible in FIG. 2.

The armature retainer guiding surface 31 defines a guiding portion of the armature retainer 15. The guiding portion merges with a stopper portion of the armature retainer 15 at a downstream axial end of the guiding portion. In the interface region between the guiding portion and the stopper portion, the armature guide 15 has a circumferential constriction. In the present embodiment, the stopper portion is in the basic shape of a disc having a rounded outer contour. In another embodiment, it has a wedged shape in a longitudinal section view, i.e., it tapers in the radial outward direction.

The stopper portion of the armature retainer 15 comprises an armature retainer limiting surface 35 of the armature retainer 15 for limiting the axial displacement of the armature 23 relative to the valve needle 7. The armature retainer limiting surface 35 enables, for example, an engagement with an armature impact area 37 of the armature 23 in order to allow the valve needle 7 to be taken along with the armature 23 when the armature 23 is axially displaced towards the pole piece 21.

In particular, the armature retainer limiting surface 35 laterally extends away from the valve needle 7, particularly projecting away from the armature retainer guiding surface 31. A lateral extension of the armature retainer limiting surface 35 is constructed such that a relative movement between the armature 23 and the armature retainer 15 is hydraulically damped. In the present embodiment this is achieved by the radial extension of the armature retainer limiting surface 35—which is also the radial extension of the stopper portion of the armature retainer 15—being at least twice as large as the radial extension of the guiding portion of the armature retainer 15.

The pole piece 21 further comprises a pole piece constriction surface 25 that is facing towards the armature 23. Moreover, the armature retainer 15 comprises an armature retainer constriction surface 17, towards which the pole piece constriction surface 25 is facing. The armature retainer constriction surface 17 is arranged at an axial side of the stopper portion opposite of that axial side on which the armature retainer limiting surface 35 is arranged.

Particularly, at least when the valve needle 7 is axially displaced in a range from a maximum displacement away from the closing position to a restriction displacement, the armature retainer constriction surface 17 and the pole piece constriction surface 25 comprise a smallest distance between the pole piece 21 and the armature retainer 23 in the axial region of the stopper portion, forming a hydraulically effective restriction between the armature retainer constriction surface 17 and the pole piece constriction surface 25.

In other words, a gap between the pole piece 21 and the armature retainer 15, through which fluid may flow, changes depending on the axial displacement of the armature retainer 15. In particular, an axial distance between the pole piece constriction surface 25 and the armature retainer constriction surface 17 decreases when the armature retainer 15 is axially displaced towards the pole piece 21. A hydraulic diameter of the hydraulically effective restriction is dependent on the axial displacement of the valve needle 7 from the closing position and is at least twice at large when the valve needle 7 is in the closing position compared to the hydraulic diameter when the valve needle 7 is at the maximum displacement away from the closing position.

In particular, the maximum displacement of the valve needle 7 away from the closing position may be reached when the valve needle 7 is in an opening position, in which, for example, the armature 23 abuts the pole piece 21.

Moreover, the restriction displacement of the valve needle 7 away from the closing position may particularly be greater than zero. In particular, the restriction displacement, respectively the range is dimensioned as to allow a formation of the hydraulically effective restriction between the armature retainer constriction surface 17 and the pole piece constriction surface 25, while still enabling fluid to flow through the cavity 11 such that a pressure difference in the axial direction is small enough to allow for a reliable and efficient injection of the injector 1.

The valve needle 7 is solid so that the fluid has to flow axially along the valve needle 7 on the outside of the valve needle from a fluid inlet end of the valve body 5 through the cavity 11—and thus through the hydraulically effective restriction—to a fluid outlet end of the valve body 5 to the valve seat 13. Due to the hydraulically effective restriction between the armature retainer constriction surface 17 and the pole piece constriction surface 25, a first damping force is exerted on the valve needle 7 when the armature retainer 15 is axially displaced towards the pole piece 21. Advantageously, a velocity of the valve needle 7 is thereby decreased such that a controllability of the injection, particularly in a ballistic phase 63 (see FIG. 3*a*) of an opening phase of the injector is contributed to. Particularly, a variation of an amount of injected fluid within a given time window 61 (see FIG. 3*a*) is kept low.

Particularly, the restriction displacement, respectively the range is dimensioned as to enable an exertion of a desired damping force on the valve needle 7. Particularly, it is further dimensioned such that the velocity of the valve needle 7 is substantially uninfluenced in a first instant of the opening phase of the injector 1

In one embodiment, the armature retainer constriction surface 17 has a first sloped shape. Particularly, the pole piece constriction surface 25 may have a second sloped shape. This enables the effective hydraulic restriction to be formed by merely a small section of the armature retainer 15, allowing the first damping force to be reliably provided, particularly in the case when the valve needle 7 is tilted. The second sloped shape may be equally sloped to the first sloped shape.

In one embodiment, the armature retainer constriction surface 17 has a first curvature. Particularly, the pole piece constriction surface 25 has a second curvature. The second curvature may be less than or equal to the first curvature. This enables the effective hydraulic restriction to be formed by merely a small section of the armature retainer 15, allowing the first damping force to be reliably provided, particularly in the case when the valve needle 7 is tilted. Moreover, this contributes to a prevention of jamming of the valve needle 7.

Figure 3A:
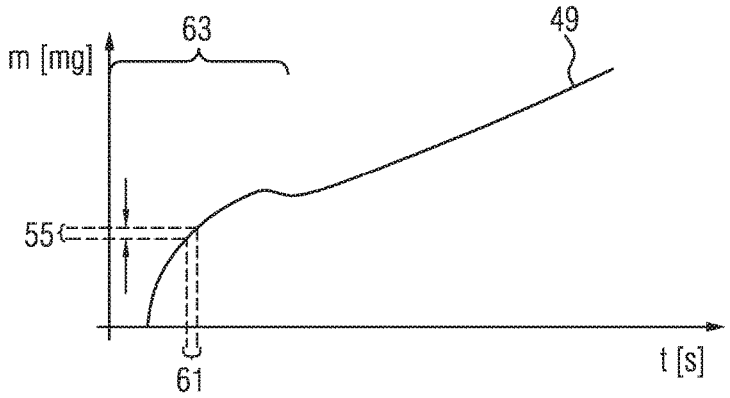
FIG. 3*a* is a first graph of an amount of injected fluid over time, by the injector of FIG. 1.
Figure 3B:
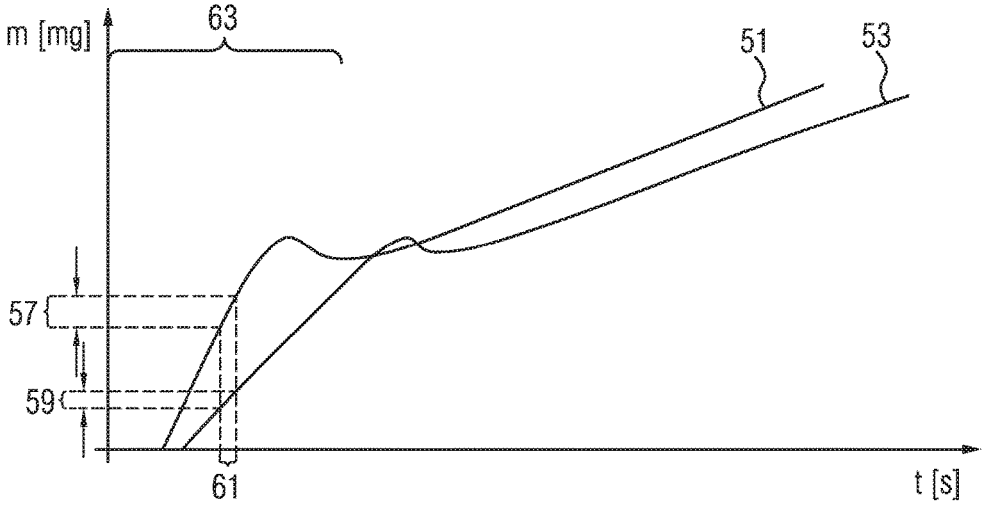
FIG 3B PRIOR ART
FIG. 3*b* is a second graph and a third graph of amounts of injected fluid over time by conventional injectors.

FIG. 3*a* shows a first graph 49 of an amount of injected fluid per activation over time of the injector 1 according to FIG. 1. Compared to a second graph 51 (FIG. 3*b*) of a fast opening injector and a third graph 53 of a slow opening injector, wherein no hydraulically effective restriction is formed between a respective armature retainer and a respective pole piece, it can be seen that a respective variability 55, 57, 59 of the amount of injected fluid within the given time window 61 of the first graph 49 is minimized, similar to the slow opening injector depicted in graph 53. Thus, it is contributed to the controllability of the injection, particularly in the ballistic phase 63. The given time window 61 is particularly given by an electrical pulse width. Moreover, the velocity of the valve needle 7 in the first instant of the opening phase is maintained, similar to the fast opening injector depicted in graph 51, thus contributing to a spray stability of the injector 1.

The invention claimed is:

1. An injector for injecting fluid, comprising:

a valve assembly comprising a valve body and a valve needle, the valve body having a longitudinal axis and comprising a cavity with a valve seat, the valve needle comprising an armature retainer, being coupled in a fixed way to the valve needle and comprising an armature retainer constriction surface, the cavity being sized to receive the valve needle at least partly therein, the cavity and the valve needle being operable to prevent in a closing position of the valve needle, in which the valve needle is seated on the valve seat, an injection of fluid from the cavity to external to the injector, and to enable the injection of fluid when the valve needle is apart from the closing position; and an electromagnetic actuator assembly, which is operable to exert a force for influencing a position of the valve needle, comprising a pole piece and an armature, the pole piece being received in the cavity, being positionally fixed within the valve body and comprising a pole piece constriction surface facing towards the armature, the armature being received in the cavity, operable to be axially displaced relative to the pole piece and to take along the armature retainer when being displaced towards the pole piece, wherein a fluid channel through which fluid which enters the cavity at a fluid inlet end of the valve body and flows to a fluid outlet end of the valve body where the valve seat is positioned is defined by the armature retainer constriction surface and the pole piece constriction surface, and a hydraulic diameter of said fluid channel is at least twice as large when the valve needle is in the closing position compared to the hydraulic diameter when the valve needle is at a maximum displacement away from the closing position, the fluid which enters the cavity at the fluid inlet end and flows to the fluid outlet end has to pass through the fluid channel between the armature retainer constriction surface and the pole piece constriction surface.

2. The injector according to claim 1, wherein the armature retainer constriction surface has a first sloped shape.

3. The injector according to claim 2, wherein the pole piece constriction surface has a second sloped shape.

4. The injector according to claim 1, wherein the armature retainer constriction surface has a first curvature.

5. The injector according to claim 4, wherein the pole piece constriction surface has a second curvature.

6. The injector according to claim 5, wherein the second curvature is less than or equal to the first curvature.

7. The injector according to claim 1, wherein a first damping force exerted on the valve needle is dependent on the position of the valve needle.

8. The injector according to claim 1, wherein the armature retainer comprises an armature retainer guiding surface and the pole piece comprises a pole piece guiding surface, wherein the armature retainer is operable for axially guiding the valve needle with the armature retainer guiding surface disposed adjacent the pole piece guiding surface when the valve needle is axially displaced.

9. The injector according to claim 8, wherein the armature retainer guiding surface is convexly curved with respect to the pole piece.

10. The injector according to claim 8, wherein the armature retainer guiding surface is substantially spherically shaped.

11. The injector according to claim 8, wherein the armature retainer guiding surface forms at least part of the fluid channel for enabling a fluid flow axially through the cavity.

12. The injector according to claim 1, wherein the armature is axially movable relative to the valve needle.

13. The injector according to claim 1, wherein the armature retainer comprises an armature retainer limiting surface for limiting an axial displacement of the armature relative to the valve needle, facing towards the armature and laterally extending away from the valve needle.

14. The injector according to claim 13, wherein the armature comprises an armature impact area facing towards the armature retainer limiting surface, the armature retainer limiting surface being operable to engage with the armature impact area, wherein a lateral extension of the armature retainer limiting surface away from the valve needle is constructed such that a relative movement between the armature and the armature retainer is damped.

15. The injector according to claim 1, wherein the armature comprises a return spring, which is operable to bias the armature in an axial direction away from the armature retainer.

16. The injector according to claim 1, wherein the armature retainer constriction surface has a convex shape and the pole piece constriction surface has a concave shape, the convex shape of the armature retainer constriction surface is adjacent the concave shape of the pole piece constriction surface when the valve needle is at the maximum displacement from the closing position.

17. The injector according to claim 1, wherein the armature retainer constriction surface and the pole piece constriction surface are spaced apart from each other when the valve needle is at the maximum displacement away from the closing position.

18. The injector according to claim 10, wherein the armature retainer guiding surface is substantially spherically shaped with at least one flat portion, the at least one flat portion forming at least part of the fluid channel.

19. An injector for injecting fluid, comprising:

a valve assembly comprising a valve body and a valve needle, the valve body having a longitudinal axis and comprising a cavity with a valve seat, the valve needle comprising an armature retainer, being coupled in a fixed way to the valve needle and comprising an armature retainer constriction surface, the cavity being sized to receive the valve needle therein, the cavity and the valve needle being operable to prevent in a closing position of the valve needle, in which the valve needle is seated on the valve seat, an injection of fluid from the cavity to external to the injector, and to enable the injection of fluid when the valve needle is apart from the closing position; and an electromagnetic actuator assembly, which is operable to exert a force for influencing a position of the valve needle, comprising a pole piece and an armature, the pole piece being received in the cavity, being positionally fixed within the valve body and comprising a pole piece constriction surface facing towards the armature, the armature being received in the cavity, operable to be axially displaced relative to the pole piece and to take along the armature retainer when being displaced towards the pole piece, wherein a fluid channel through in which fluid which enters the cavity at a fluid inlet end of the valve body and flows to a fluid outlet end of the valve body where the valve seat is positioned is defined by the armature retainer constriction surface and the pole piece constriction surface, and a hydraulic diameter of said fluid channel is and at least twice as large when the valve needle is in the closing position compared to the hydraulic diameter when the valve needle is at a maximum displacement away from the closing position, wherein the fluid channel is configured such that all of the fluid which enters the cavity at the fluid inlet end and flows to the fluid outlet end passes between the armature retainer constriction surface and the pole piece constriction surface.

20. The injector according to claim 19, wherein the armature retainer constriction surface has a convex shape and the pole piece constriction surface has a concave shape, the convex shape of the armature retainer constriction surface is adjacent the concave shape of the pole piece constriction surface when the valve needle is at the maximum displacement from the closing position.

* * * * *